US006638106B1

(12) United States Patent
Wu

(10) Patent No.: US 6,638,106 B1
(45) Date of Patent: Oct. 28, 2003

(54) MULTI-PORT ELECTRICAL CONNECTOR HAVING IMPROVED BOARD LOCKS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/256,776

(22) Filed: Sep. 27, 2002

(51) Int. Cl.[7] ..... H01R 13/60
(52) U.S. Cl. ..... 439/567
(58) Field of Search ..... 439/567, 660, 439/607, 670, 83, 79

(56) References Cited

U.S. PATENT DOCUMENTS 5,277,597 A * 1/1994 Masami et al. ..... 439/83
5,540,598 A * 7/1996 Davis ..... 439/79
5,921,787 A * 7/1999 Pope et al. ..... 439/74
6,179,630 B1 * 1/2001 Chang ..... 439/79

* cited by examiner

*Primary Examiner*—Lynn Feild
*Assistant Examiner*—Phuong K T Din
(74) *Attorney, Agent, or Firm*—Wei Te Chung

(57) ABSTRACT

A dual-port electrical connector (1) for being mounted onto a circuit board comprises a dielectric housing (10), a plurality of conductive contacts (20), and a pair of board locks (30). The housing forms a base (12) and a pair of tongues (14) projecting upwardly from the base. The base defines a pair of slits (17) at opposite ends thereof. Each tongue defines a plurality of passageways (13) in a mating face (11) thereof for receiving the conductive contacts. Each board lock is retained into a corresponding slit and forms a latch portion (32) inserted into a corresponding hole defined in a circuit board and at least one side portion (34) beside the latch portion for being soldered to the circuit board by surface mounting technology.

5 Claims, 12 Drawing Sheets

MULTI-PORT ELECTRICAL CONNECTOR HAVING IMPROVED BOARD LOCKS

CROSS-REFERENCE TO RELATED APPLICATION

This application is a application of U.S. patent application Ser. No. 10/210383, entitled "TWO PORTS INTEGRAL ELECTRICAL CONNECTOR", invented by the same inventor, and assigned to the same assignee. The disclosures of the co-pending application are incorporated herein by reference.

BACKGROUND OF THE INVENTION

1. Field of the Invention

The present invention relates to an electrical connector, and particularly to a multi-port electrical connector having an improved board lock device for more stably mounting the multi-port electrical connector on a printed circuit board.

2. Description of Prior Art

Board locks are popularly used in many electrical connectors for attaching the electrical connectors to circuit boards thereunder. A conventional board lock is generally shaped like a fork and has a pair of legs inserted into and soldered to a corresponding hole defined in the circuit board to thereby attach the electrical connector to the circuit board. Such board locks are disclosed in U.S. Pat. Nos. 5,419,713, 5,820,393, and 5,664,965. However, these board locks cannot sufficiently stably secure a connector with multiple ports to a circuit board since the multi-port connector generally has a width larger than that of a single-port connector. The board locks used in the co-pending '383 application are found not able to stably secure the dual-port connector thereof to a printed circuit board. Therefore, it is necessary to devise a board lock which can securely fix a multi-port connector to a printed circuit board.

Hence, a multi-port electrical connector with an improved board lock is desired to meet the above-mentioned demand.

SUMMARY OF THE INVENTION

Accordingly, a first object of the present invention is to provide an improved board lock for a multi-port electrical connector, which can securely and reliably retain the multi-port electrical connector to an underlying circuit board.

A second object of the present invention is to provide a multi-port electrical connector which can be easily, conveniently and securely mounted to an underlying circuit board.

T o fulfill the above-mentioned objects, an electrical connector for being mounted onto a circuit board in accordance with the present invention comprises a dielectric housing, a plurality of conductive contacts received in the housing, and a pair of board locks. The housing forms a base and a pair of tongues projecting from the base. The base defines a pair of slits at opposite ends thereof and a pair of chamfer portions at opposite sides thereof for leaving enough space with respect to solder tails of the contacts to thereby facilitating soldering. Each tongue defines a plurality of passageways in a mating face thereof for receiving the conductive contacts. Each board lock is retained into a corresponding slit and forms a latch portion inserted into a corresponding hole defined in a circuit board and at least one side portion beside the latch portion for being mounted on a top face of the circuit board.

Other objects, advantages and novel features of the invention will become more apparent from the following detailed description when taken in conjunction with the accompanying drawings.

DETAILED DESCRIPTION OF THE INVENTION

Reference will now be made to drawings, and particularly to FIG. 1, a dual-port electrical connector 1 in accordance with a first embodiment of the present invention is shown. The electrical connector 1 is formed by integrally combining two connector halves together. The connector 1 comprises a dielectric housing 10, two rows of conductive contacts 20, and a pair of board locks 30 for retaining the electrical connector 1 to an underlying circuit board (not shown).

Figure 9:
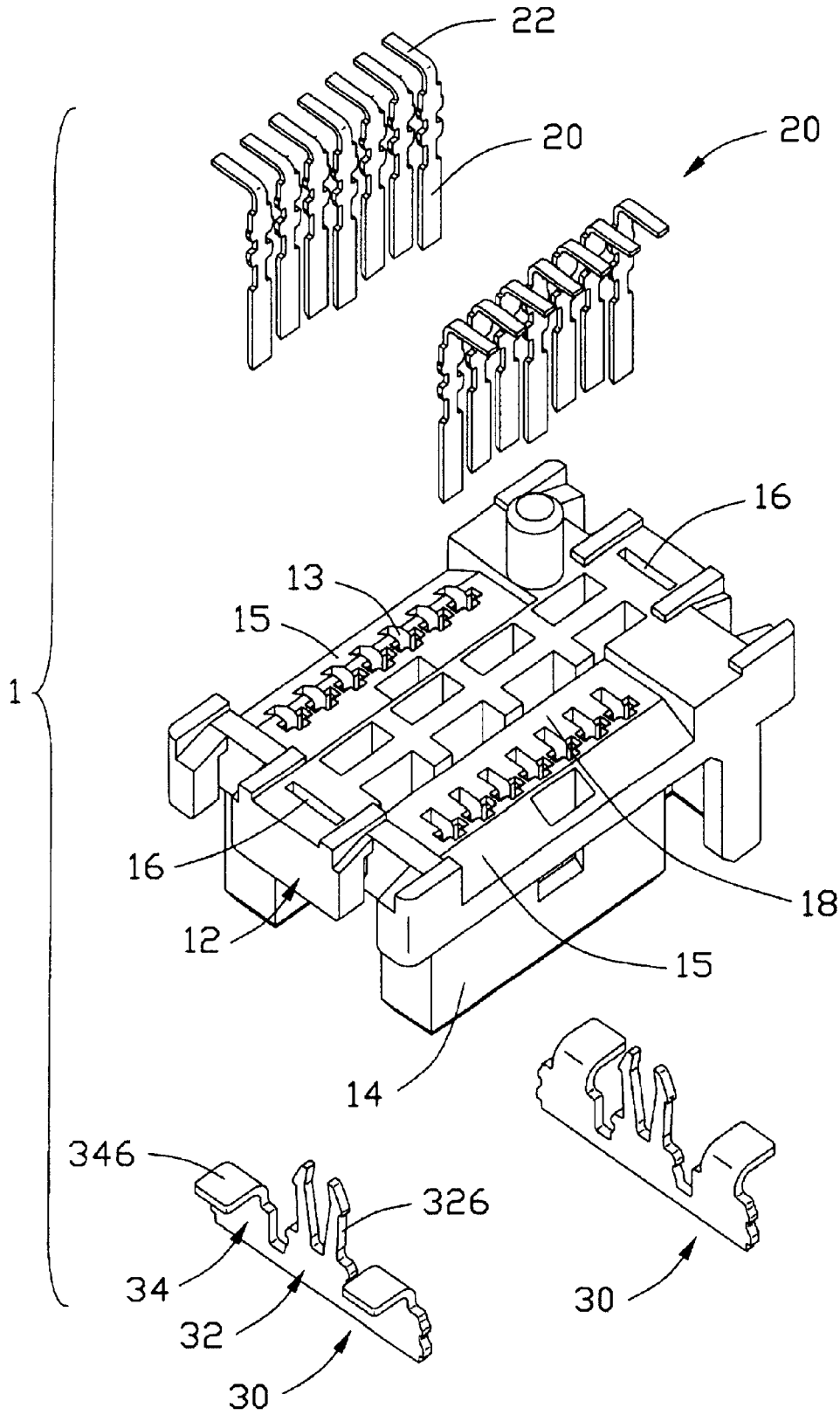
FIG. 9 is a perspective, exploded view of the electrical connector of FIG. 1.
Figure 10:
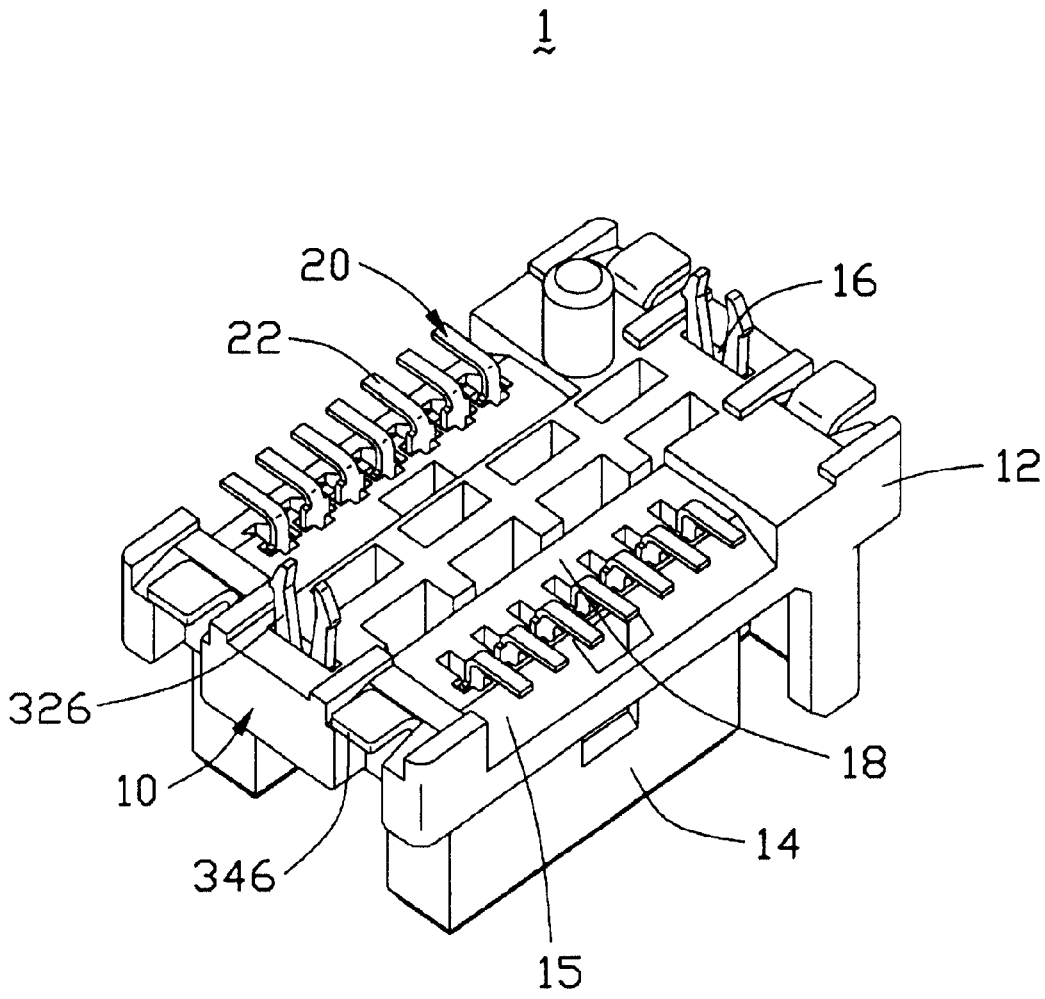
FIG. 10 is an assembled view of FIG. 9.

Further referring to FIGS. 2 to 10, the housing 10 includes a base 12 and a pair of tongues 14 projecting upwardly from a top face 122 of the base 12. The base 12 defines a pair of slits 17 in opposite ends thereof, respectively, and a pair of cutouts 19 is defined outside and communicated with each of the slits 17. Additionally, a through hole 16 is defined in a bottom face 18 of the base 12 and communicated with each slit 17 (FIG. 9). The bottom face 18 of the base 12 defines a pair of chamfered portions 15 at opposite outer sides thereof. The tongues 14 have a same structure and are parallel to each other. Each tongue 14 has a mating surface 11 defining a plurality of passageways 13 therein for receiving a corresponding row of conductive contacts 20. The passageways 13 further extend through opposite top and bottom faces 122, 18 of the base 12.

In structure, the two rows of conductive contacts 20 are similar to those disclosed in the co-pending '383 application, except that soldering tails 22 of the present invention are SMT (Surface Mounting Technology) type, not T/H (Through Hole) type disclosed in the co-pending '383 application. Thus, detailed description of the conductive contacts 20 is omitted herewith.

The pair of board locks 30 each have a latch portion 32 and a pair of side portions 34 integrally formed at opposite sides of the latch portion 32. The latch portion 32 has a configuration like a conventional board lock with a body portion 322 forming barbs 324 on opposite sides thereof, and a pair of legs 326 depending from the body portion 322. The side portions 34 each include a body section 342 forming barbs 344 on an outer side thereof and a horizontal section 346 outwardly extending from the body section 342, perpendicular to the body section 342.

In assembly, referring to FIGS. 1 to 10, the two rows of conductive contacts 20 are inserted into corresponding passageways 13 from the bottom face 18 of the housing 10 for mating with a complementary connector (not shown). The pair of board locks 30 is inserted into corresponding slits 17 from an upper side of the housing 10. The barbs 324, 344 of the latch portions 32 and the side portions 34 bite into the housing 10 in the slits 17. Meanwhile, the pair of legs 326 and the horizontal sections 346 of each board lock 30 are extended into a corresponding hole 16 and the cutouts 19 communicated with the corresponding slit 17, respectively. The legs 326 and the horizontal sections 346 extend out of the bottom face 18 of the housing 10. Then, the electrical connector 1 is mounted onto the underlying circuit board and the legs 326 of the board locks are inserted into corresponding holes (not shown) defined in the circuit board. Finally, the horizontal sections 346 of the board locks 30 and the soldering tails 22 of the contacts 20 are soldered to the underlying circuit board by SMT, and then the legs 326 are subject to a wave soldering process thereby securely and effectively retaining the electrical connector 1 to the circuit board. In the present invention, the chamfered portions 15 of the bottom face 18 facilitate the re-work of the soldering joints of the soldering tails 22 and the circuit board. The chamfered portions 15 are formed at outer sides of the bottom face 18.

Figure 11:
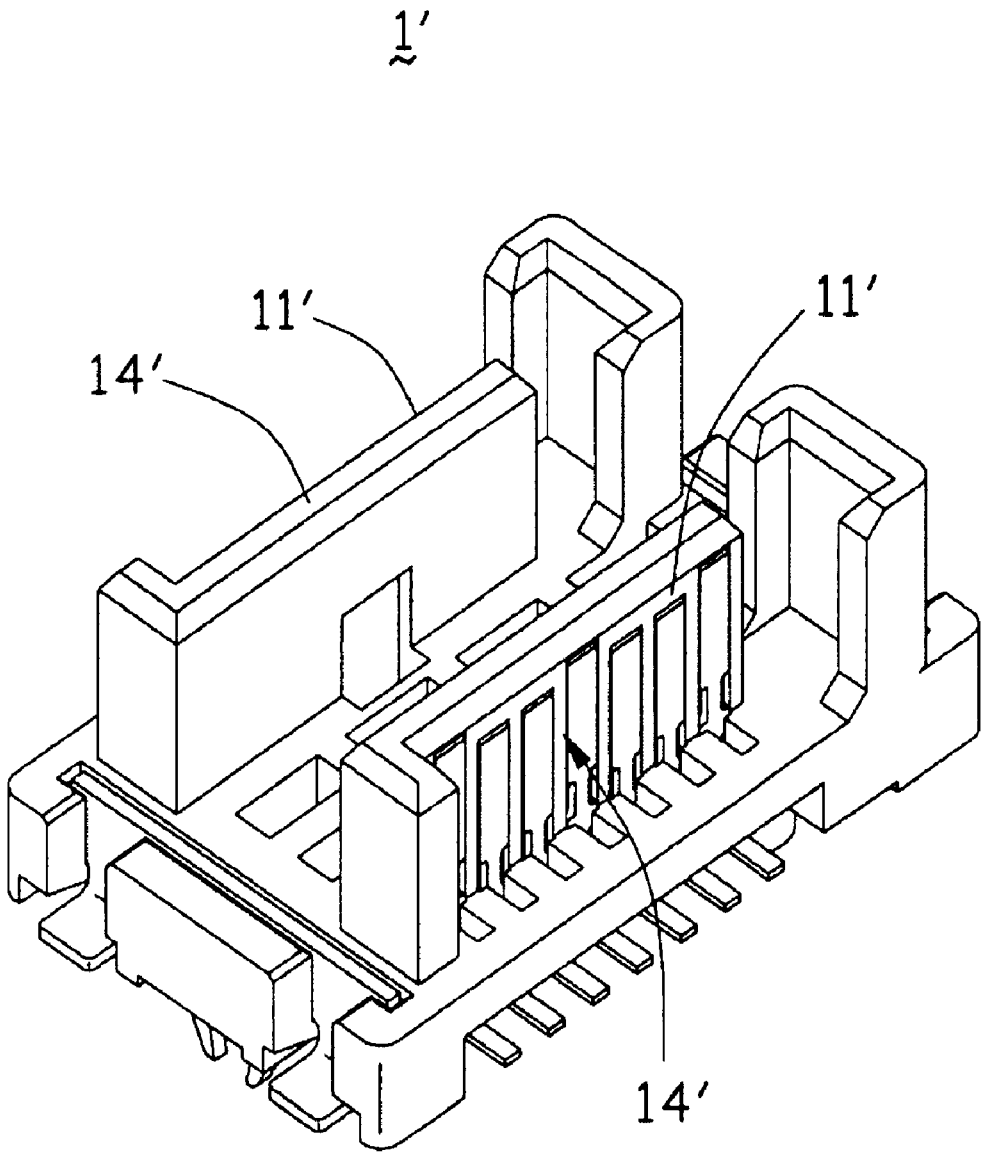
FIG. 11 is a perspective view of a dual-port electrical connector in accordance with a second embodiment of the present invention.
Figure 12:
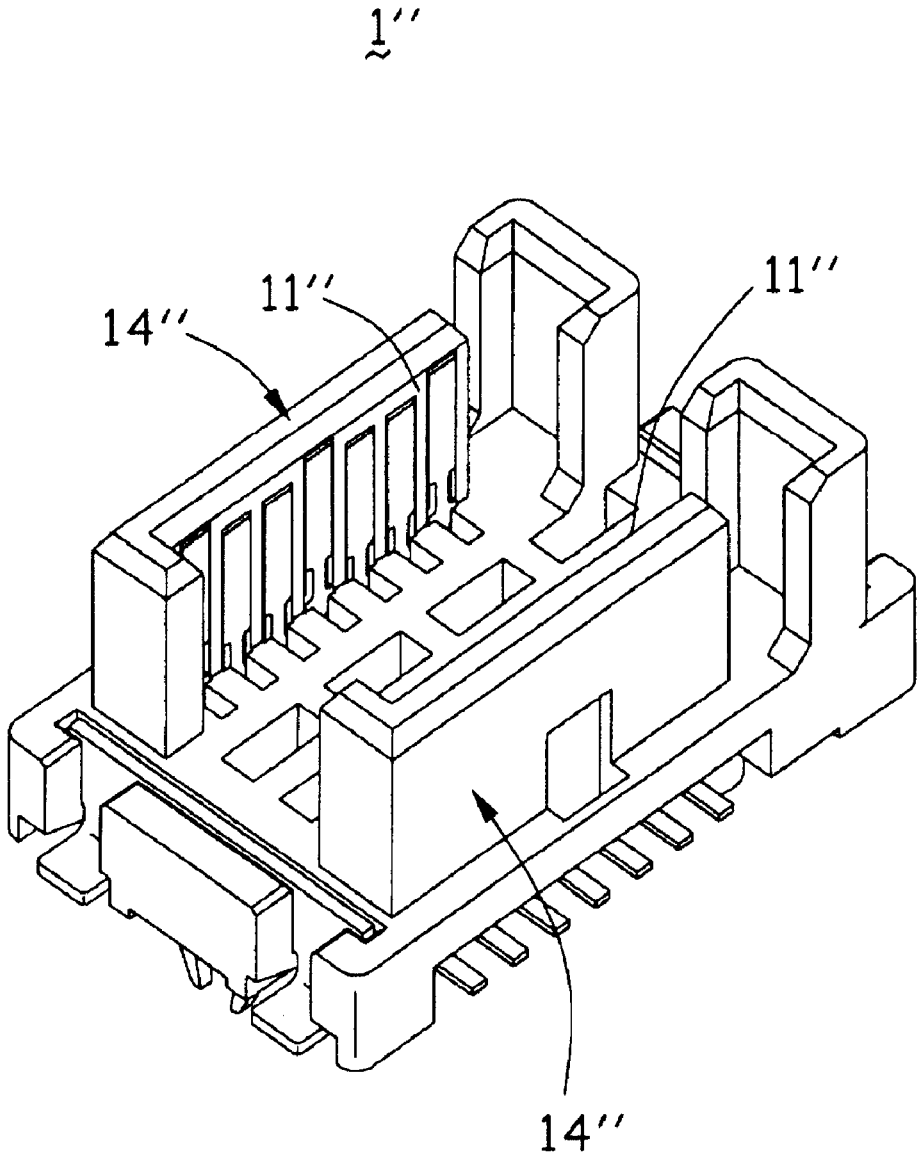
FIG. 12 is a perspective view of a dual-port electrical connector in accordance with a third embodiment of the present invention.

Referring to FIGS. 11 and 12, two electrical connectors 1' and 1" in accordance with second and third embodiments of the present invention are respectively shown in their perspective views. The connectors 1' and 1" are both similar to the electrical connector 1 in the first embodiment of the present invention, except that the mating faces 11 of the tongues 14 of the first embodiment face a same direction, the mating faces 11' of the tongues 14" of the second embodiment face opposite directions and the mating faces 11" of the tongues 14" of the third embodiment face each other.

Figure 1:
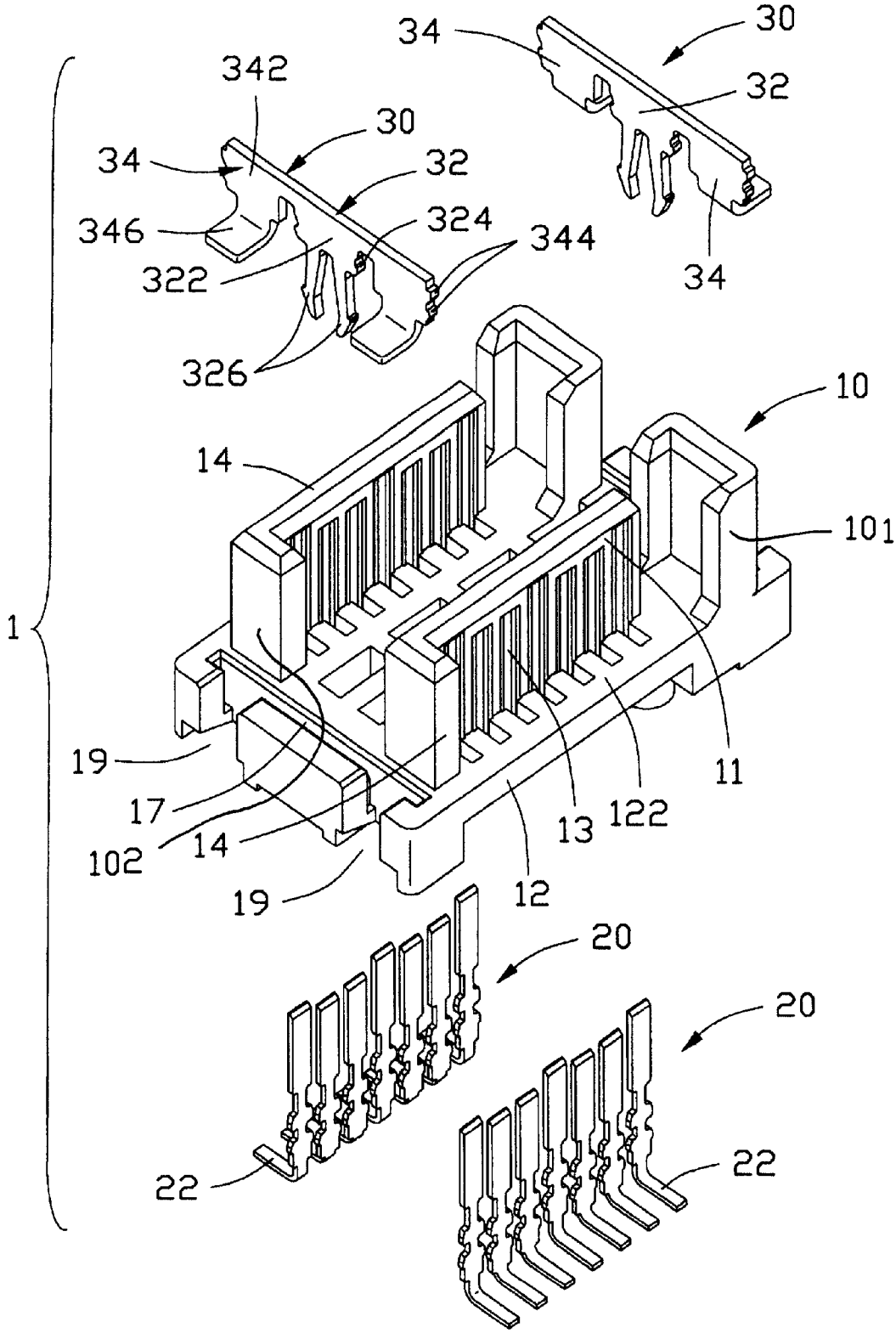
FIG. 1 is a perspective, exploded view of a dual-port electrical connector in accordance with a first embodiment of the present invention.
Figure 2:
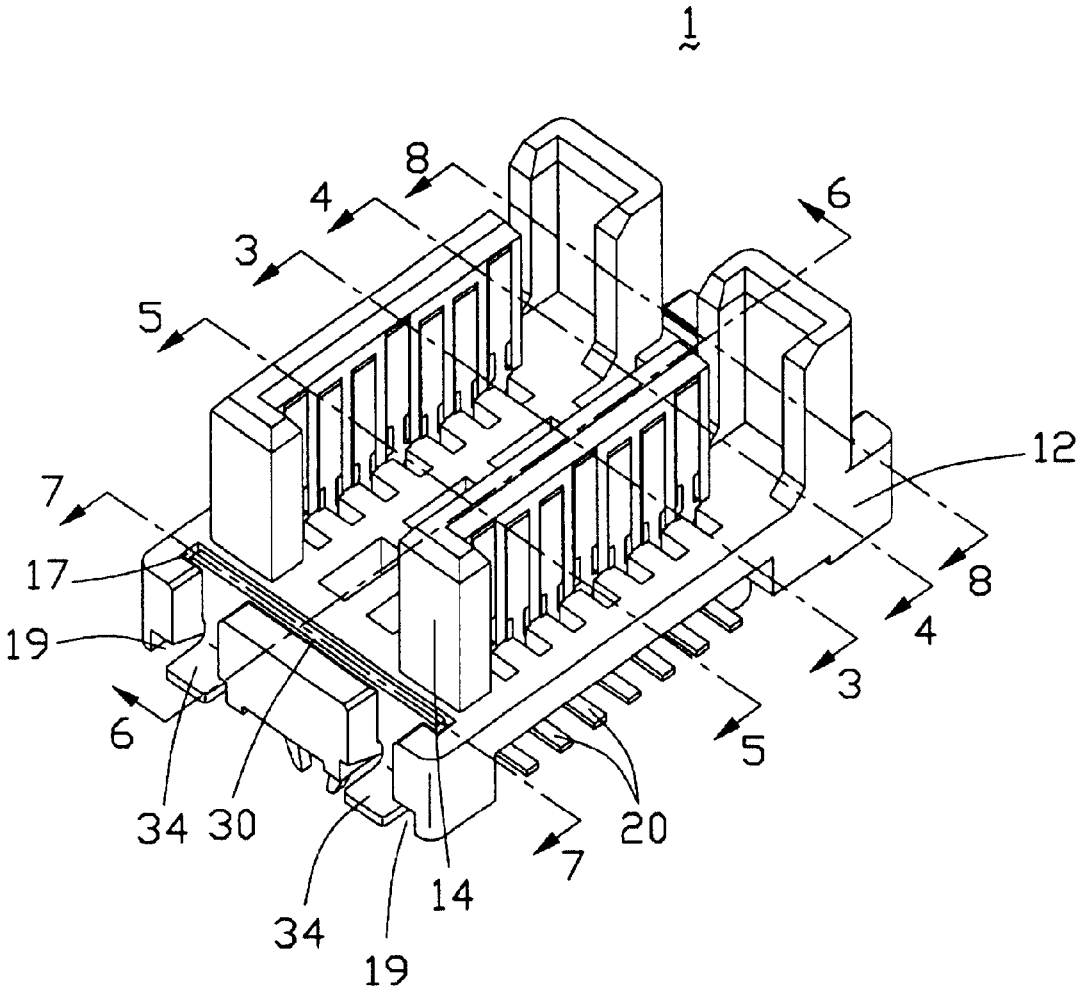
FIG. 2 is an assembled view of FIG. 1.
Figure 3:
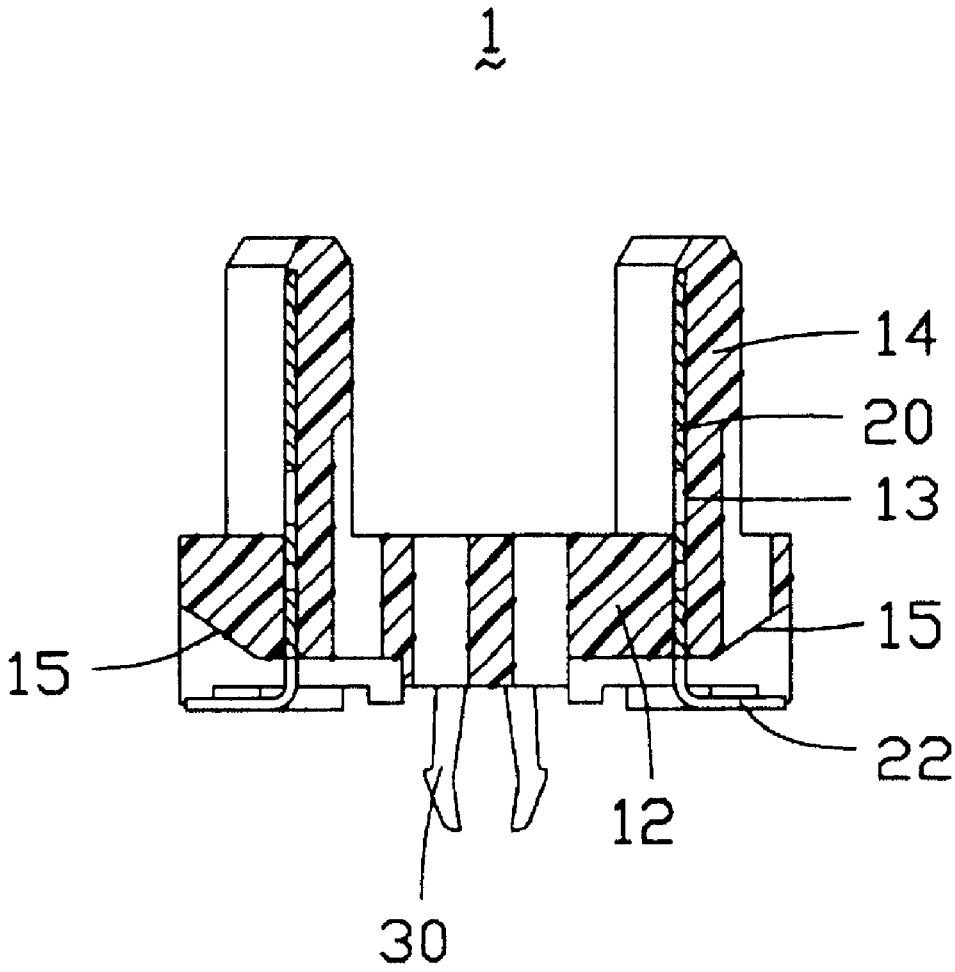
FIG. 3 is a cross-sectional view taken along line 3—3 of FIG. 2.
Figure 4:
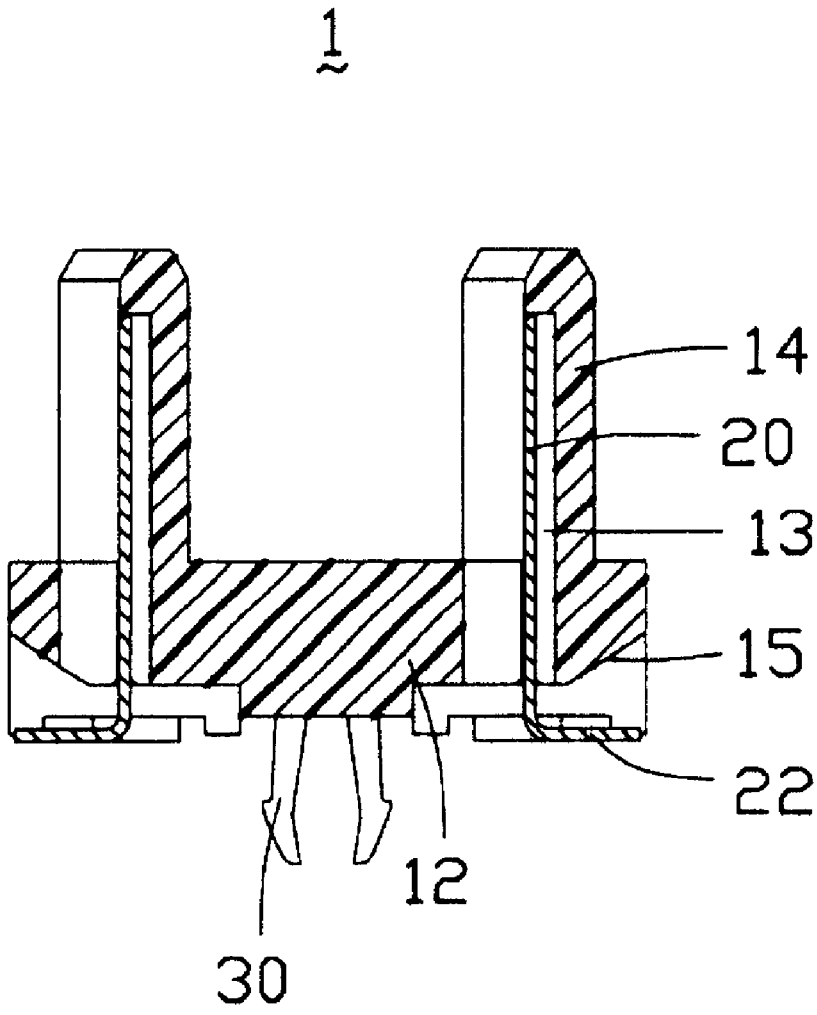
FIG. 4 is a cross-sectional view taken along line 4—4 of FIG. 2.
Figure 5:
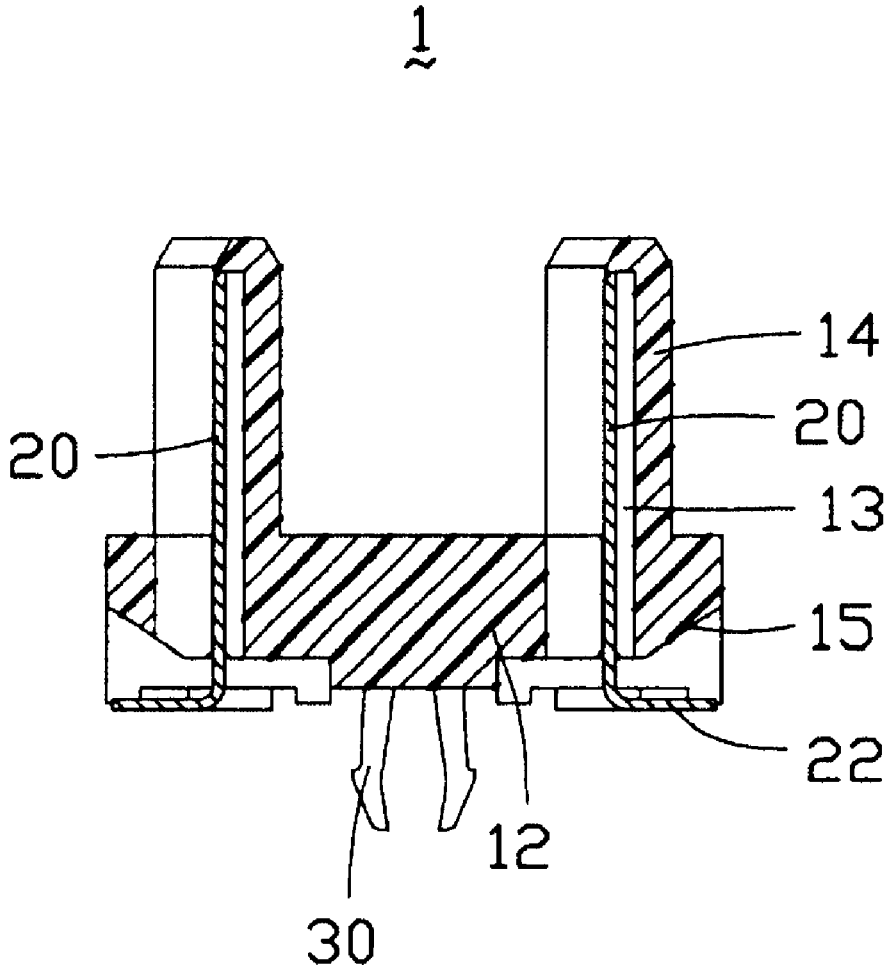
FIG. 5 is a cross-sectional view taken along line 5—5 of FIG. 2.
Figure 6:
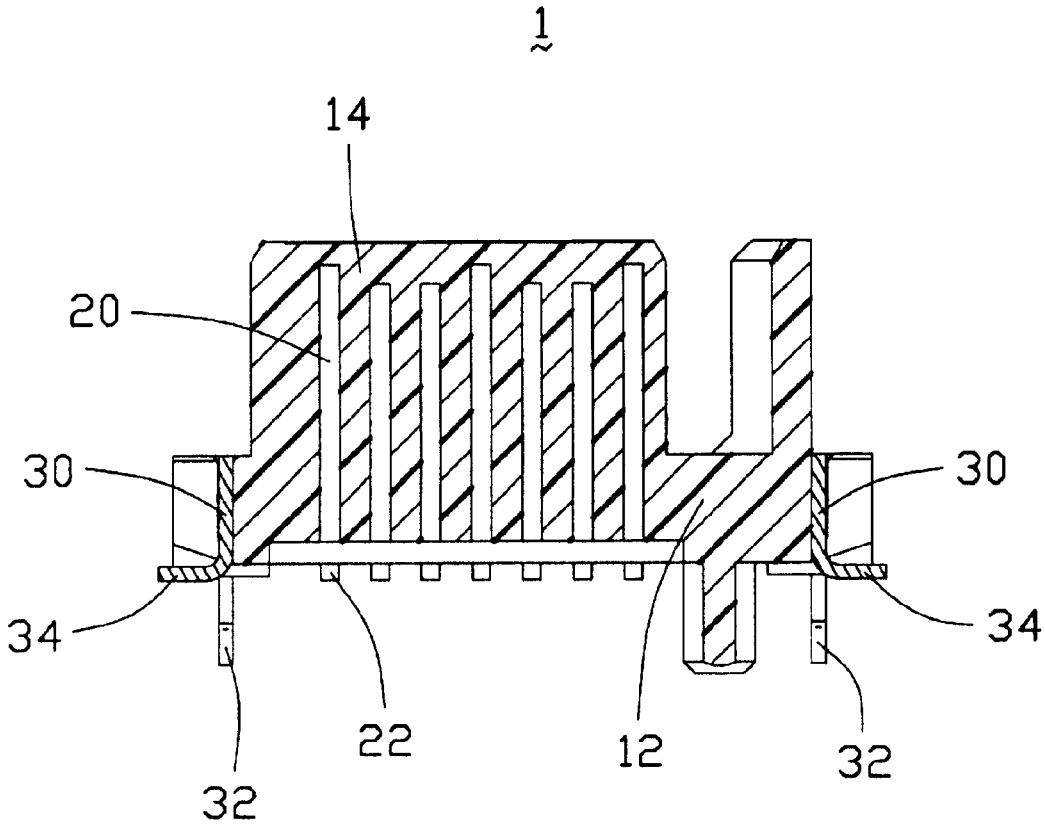
FIG. 6 is a cross-sectional view taken along line 6—6 of FIG. 2.
Figure 7:
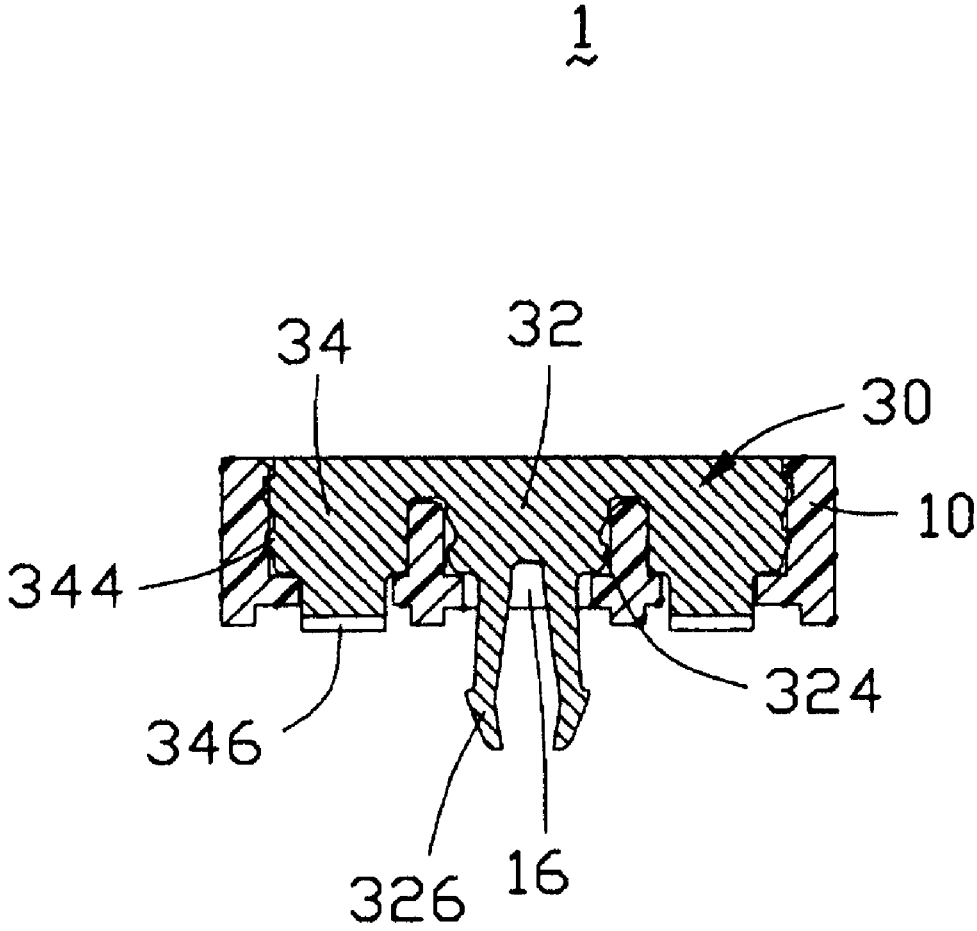
FIG. 7 is a cross-sectional view taken along line 7—7 of FIG. 2.
Figure 8:
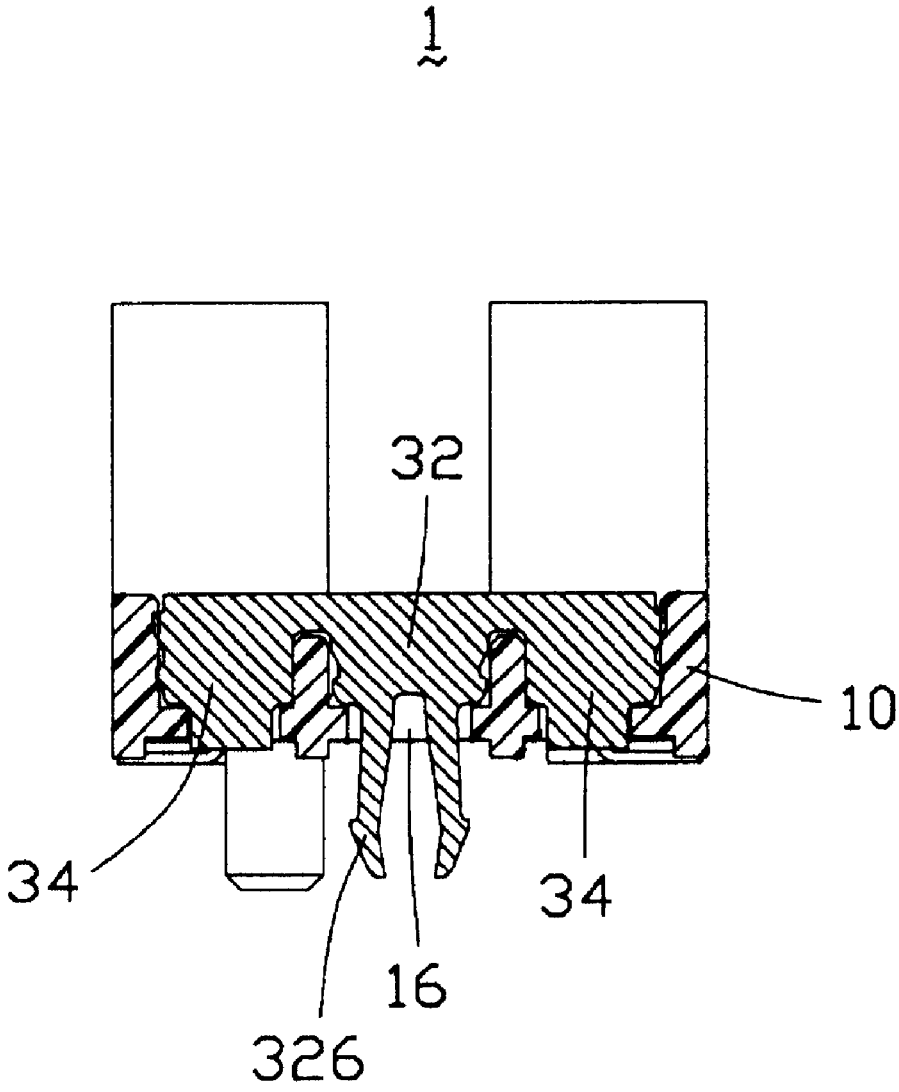
FIG. 8 is a cross-sectional view taken along line 8—8 of FIG. 2.

It is noted that from another viewpoint in the first embodiment, the connector 1, as indicated in paragraph [0021], is essentially formed by integrally combining two regular simplex unit, wherein referring to FIG. 1, for each of both such simplex units, the vertical section 102 of the L-shaped mating tongue 14 upwardly extends from the right side of the horizontal section (not labeled) thereof opposite to the U-shaped confinement structure 101. Differently, in the second and third embodiments, even though each connector is also formed by two simplex units, one simplex unit is of this regular form while the other is of a reverse form where the vertical section extends upwardly from a left side of the horizontal section of the L-shaped mating tongue opposite to the U-shaped confinement structure. Understandably, based on this arrangement, these two simplex units may perform a mirror image manner.

As disclosed in a copending application filed Sep. 11, 2002 having the same inventor and the same assignee with the instant application and with an unknown serial number and titled "ELECTRICAL CONNECTOR WITH LOCKING MEMBER", on the other hand recently the complementary plugs are equipped with latches for preventing relative rotation between the (simplex) connectors and the complementary plugs during mating. Understandably, the duplex type, i.e., dual ports, connector generally requires the corresponding two complementary simplex plugs to be mated in an opposite manner to have the associated two latches located on the outer sides thereof for easy operation without interference. Otherwise, if it still uses the two regular simplex units, the latch of one complementary simplex plug will be obstructed between the two mating tongues. Under a regular design, if it directly makes one regular simplex unit upside down joined with another regular one to have the two complementary regular simplex plugs mated with an opposite manner with each other, the U-shaped confinement structures of these two regular simplex units will be located on opposite sides of the integral housing, thus resulting in a somewhat unfriendly odd configuration for the dual-port/duplex connector.

Differently, in the second and third embodiments of the instant invention, a reverse type simplex unit is introduced which cooperates a reverse type plug so as to have the whole dual port connector may mate the two complementary plugs equipped with latches, of which one is of the regular type and the other is also of the reverse type, under a neat, symmetric/mirror image, friendly and easy for operation way.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted onto a circuit board, comprising:

a dielectric housing having a base and a pair of tongues projecting from the base, the base defining a pair of slits at opposite ends thereof, each tongue defining a plurality of passageways in a mating face thereof;

a plurality of conductive contacts being received in corresponding passageways; and a pair of board locks being respectively retained into the pair of slits, each board lock forming a latch portion for being inserted into a hole defined in the circuit board and a pair of side portions for being soldered on a top face of the circuit board; wherein the base defines in a bottom face thereof a hole communicated with the corresponding slit for extension of a pair of legs of the latch portion therethrough; wherein each of said side portions has a body section forming barbs at one side thereof for biting into the base defining a corresponding slit, and a horizontal section extending from the body section for being soldered to the top face of the circuit board; wherein the base defines at each of the opposite ends thereof a pair of cutouts outside and communicated with each slit for extension of the horizontal sections of the side portions.

2. The electrical connector as claimed in claim 1, wherein each conductive contact forms a horizontal tail for soldering to the circuit board and wherein the base plate defines at an outer side of a bottom face thereof a chamfered portion spaced from the horizontal tail a distance for facilitating re-work of a soldering joint of the horizontal tail to the circuit board.

3. The electrical connector as claimed in claim 1, wherein the pair of tongues is parallel to each other and the mating faces face a same direction.

4. The electrical connector as claimed in claim 1, wherein the mating faces of the pair of tongues face each other.

5. An electrical connector for being mounted onto a circuit board, comprising:

a dielectric housing having a base and a pair of tongues projecting from the base, the base defining a pair of slits at opposite ends thereof, each tongue defining a plurality of passageways in a mating face thereof;

a plurality of conductive contacts being received in corresponding passageways and each forming a horizontal tail extending out of the housing for soldering to the circuit board; and a pair of board locks being respectively retained to the pair of slits, each board lock forming a latch portion for being inserted into a hole defined in the circuit board and a pair of side portions for being soldered on a top face of the circuit board;

the base defines a chamfer portion spaced apart from the horizontal tails of the conductive contacts to thereby leaving enough space for facilitating to solder the horizontal tails to the circuit board; wherein the base defines in a bottom face thereof a hole communicated with the corresponding slit for extension of a pair of legs of the latch portion therethrough; wherein each of said side portions has a body section forming barbs at one side thereof for biting into the base defining a corresponding slit, and a horizontal section extending from the body section for being soldered to the top face of the circuit board; wherein the base defines at each of the opposite ends thereof a pair of cutouts outside and communicated with each slit for extension of the horizontal sections of the side portions.

* * * * *